US006300021B1

(12) United States Patent
Gorog et al.

(10) Patent No.: US 6,300,021 B1
(45) Date of Patent: Oct. 9, 2001

(54) BIAS SHIELD AND METHOD OF DEVELOPING A LATENT CHARGE IMAGE

(75) Inventors: Istvan Gorog; David Paul Ciampa, both of Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/333,235

(22) Filed: Jun. 14, 1999

(51) Int. Cl.[7] ..... G03G 13/06

(52) U.S. Cl. ..... 430/23; 430/103; 427/469; 427/476; 396/546; 118/622

(58) Field of Search ..... 430/103, 23; 396/546; 427/476, 469; 118/622

(56) References Cited

U.S. PATENT DOCUMENTS

| | | | | |
|---|---|---|---|---|
| 3,558,310 | | 1/1971 | Mayaud | 96/36.1 |
| 4,707,428 | * | 11/1987 | Terao et al. | 430/103 |
| 4,921,767 | | 5/1990 | Datta et al. | 430/23 |
| 5,093,217 | | 3/1992 | Datta et al. | 430/28 |
| 5,370,952 | | 12/1994 | Datta et al. | 430/28 |
| 5,477,285 | | 12/1995 | Riddle et al. | 354/1 |
| 5,519,217 | | 5/1996 | Wilbur, Jr. et al. | 250/326 |
| 5,554,468 | | 9/1996 | Datta et al. | 430/28 |
| 5,637,357 | * | 6/1997 | Stachelhaus et al. | 427/476 |
| 5,976,739 | * | 11/1999 | Lee et al. | 430/23 |
| 6,007,952 | * | 12/1999 | Ciampa et al. | 430/23 |

FOREIGN PATENT DOCUMENTS 0647959A 12/1995 (EP) .

OTHER PUBLICATIONS

PCT Search Report; Sep. 28, 2000.

* cited by examiner

*Primary Examiner*—Christopher Rodee

(57) ABSTRACT

The invention includes an apparatus 40 for developing a latent charge image formed on a photoreceptor 36 disposed on an interior surface of a faceplate panel 12. The apparatus 40 comprises a developer tank 42 having a sidewall 44 closed at one end by a bottom portion 46 and at the other end by a panel support 48 having an opening 50 therethrough to provide access to the faceplate panel 12. A back electrode 52 has a potential applied thereto to establish an electrostatic drift field between the back electrode and the photoreceptor 36, which is grounded. Triboelectrically-charged, dry-powdered, light emitting phosphor material, having a charge of the same polarity as the potential applied to the back electrode 52, is sprayed into the developer tank 42, between the back electrode 52 and the faceplate panel 12. The triboelectrically charged phosphor material is directed toward the photoreceptor 36 on the faceplate panel 12 by the applied electrostatic drift field. A bias shield 65 comprising two pairs of insulative shield members 66 and 68 disposed around a peripheral sidewall 18 of the faceplate panel 12. At least one conductive strip 72 is provided on one of the major surfaces of the shield members to repel the triboelectrically charged phosphor material from the panel sidewall 18 and to influence the deposition of the phosphor material on the photoreceptor, at the edge thereof. A method of developing the latent charge image utilizing the bias shield also is described.

1 Claim, 5 Drawing Sheets

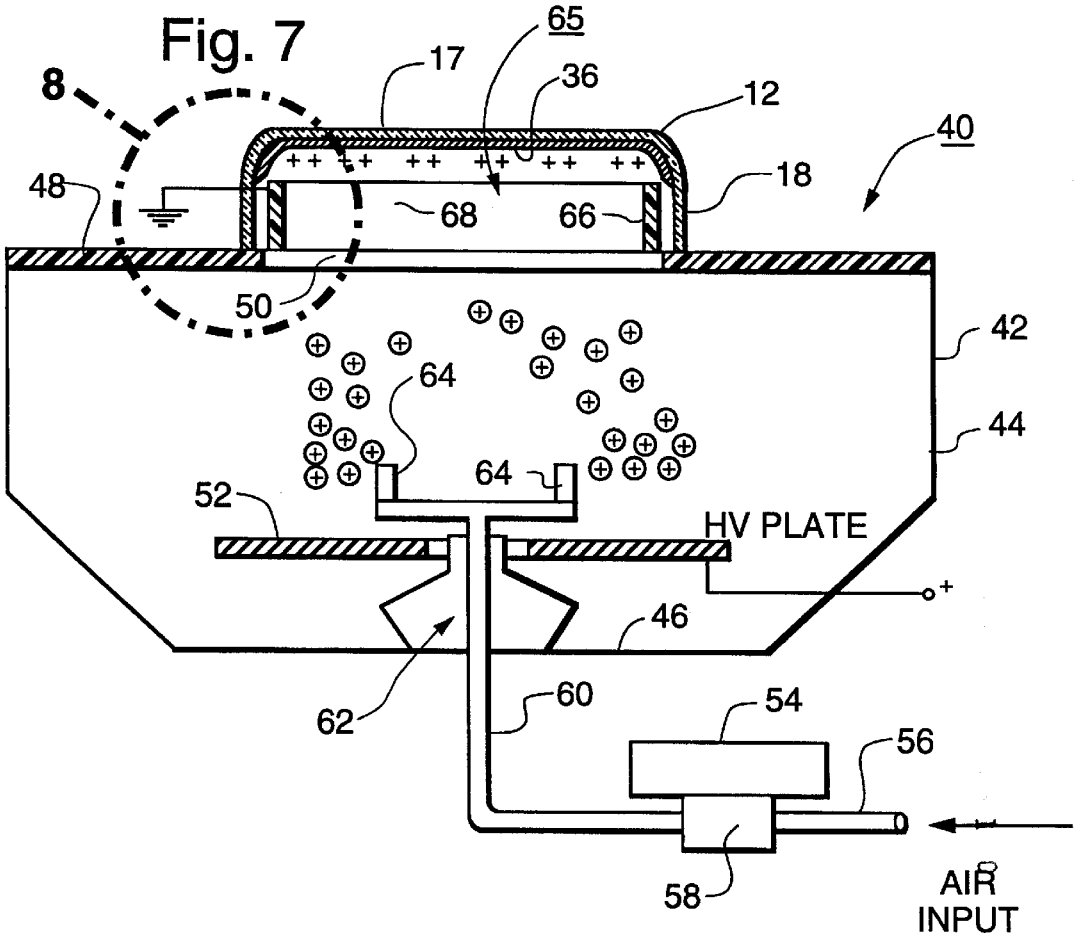
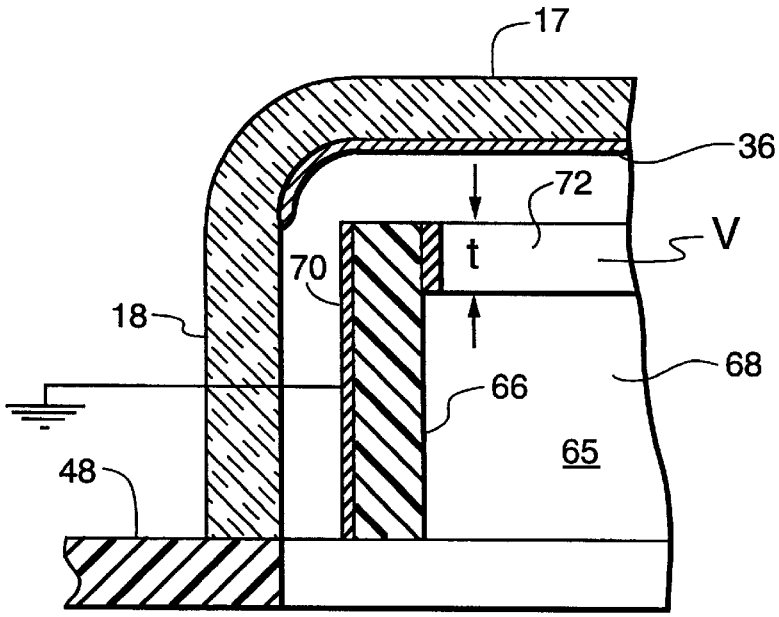
Fig. 8

BIAS SHIELD AND METHOD OF DEVELOPING A LATENT CHARGE IMAGE

The invention relates to an apparatus and method of developing a latent charge image on a photoreceptor which is disposed on an interior surface of a faceplate of a cathode-ray tube (CRT), and, more particularly, to an apparatus having a bias shield, and a method of operating a developing apparatus with the bias shield.

BACKGROUND OF THE INVENTION

U.S. patent application, Ser. No. 09/131,022, filed on Aug. 7, 1998 now U.S. Pat No. 6,007,952, and entitled, APPARATUS AND METHOD OF DEVELOPING A LATENT CHARGE IMAGE, by D. P. Ciampa et al., describes an apparatus for developing an electrostatic latent charge image on a photoreceptor that is disposed on an interior surface of a faceplate panel of a cathode-ray tube (CRT). The developing apparatus includes a developer tank having a back electrode and two pairs of panel skirt sidewall shields. The back electrode has a potential applied thereto that establishes an electrostatic drift field between the back electrode and the photoreceptor on the faceplate panel. Triboelectrically charged phosphor materials are introduced into the developer tank and directed toward the photoreceptor on the faceplate panel by the electrostatic drift field shown schematically in FIG. 1. The panel skirt sidewall shields are disposed around the peripheral sidewall of the faceplate panel to prevent the triboelectrically charged phosphor materials from reaching the sidewall of the faceplate panel. The panel skirt sidewall shields are formed of a suitable insulative material, such as ultra high molecular weight (UHMW) polyethylene. As shown in FIG. 2, to prevent the accumulation of phosphor particles on the shields, the shields are primed with positive charges that cancel the normal component of the electric field at the shields, so that the shields will not attract and accumulate the positively charged phosphor particles. While priming with positive charges reduces the accumulation of phosphor particles, it does not provide a means for controlling the amount of phosphor material deposition at the edge of the photoreceptor or of ensuring that the weight of the phosphor materials deposited in the peripheral areas of the photoreceptor is the same as that deposited in the central portion thereof A need therefore exists for a developing apparatus having means to provide uniform phosphor deposition while preventing an accumulation of phosphor materials on the shields.

SUMMARY OF THE INVENTION

In accordance with the present invention, an apparatus and method are disclosed for developing an electrostatic latent charge image which is formed on a photoreceptor that is disposed on an interior surface of a faceplate panel of a CRT. The apparatus comprises a developer tank having a sidewall closed at one end by a bottom portion and at the other end by a panel support having an opening therethrough to provide access to the panel. A back electrode is disposed within the developer tank and spaced from, but substantially parallel to, the interior surface of the faceplate panel. The back electrode has a first potential applied thereto to establish an electrostatic drift field between the back electrode and the photoreceptor that is grounded. Triboelectrically-charged, dry-powdered, light emitting phosphor materials, having a charge of the same polarity as the first potential applied to the back electrode, are introduced into the developer tank, between the back electrode and the faceplate panel. The triboelectrically charged phosphor materials are directed toward the photoreceptor on the faceplate panel by the applied electrostatic drift field. A bias shield is disposed around a peripheral sidewall of the faceplate panel. The bias shield comprises two pairs of insulative members having oppositely disposed major surfaces with at least one conductive strip provided on one of the major surfaces thereof. A suitable potential is provided to the conductive strip to create a surface electric field that directs the triboelectrically charged phosphor materials uniformly towards the photoreceptor and prevents the accumu on of phosphor materials on the bias shield.

BRIEF DESCRIPTION OF THE DRAWINGS

In the drawings:

FIG. 7 shows a developing apparatus utilized in the present invention;

FIG. 8 is an enlarged section of the CRT faceplate panel and a first embodiment of the bias shield shown within the circle 8 of FIG. 7;

DETAILED DESCRIPTION OF THE PREFERRED EMBODIMENTS

Figure 1:
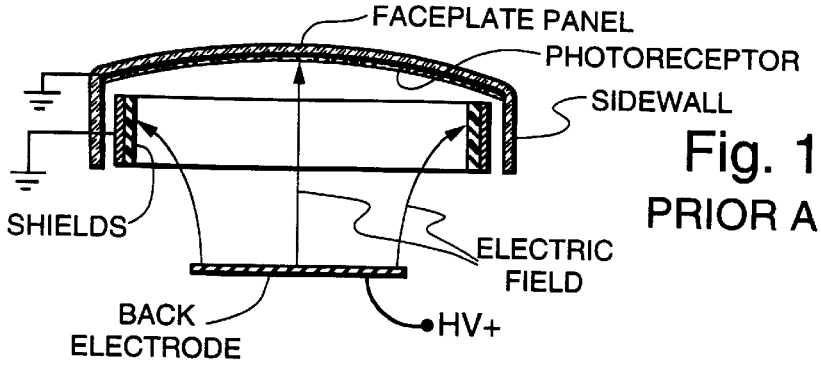
Fig. 1 PRIOR ART
FIG. 1 is a schematic diagram of the electric field lines between a back electrode and the photoreceptor before phosphor deposition, with prior art sidewall shields.
Figure 2:
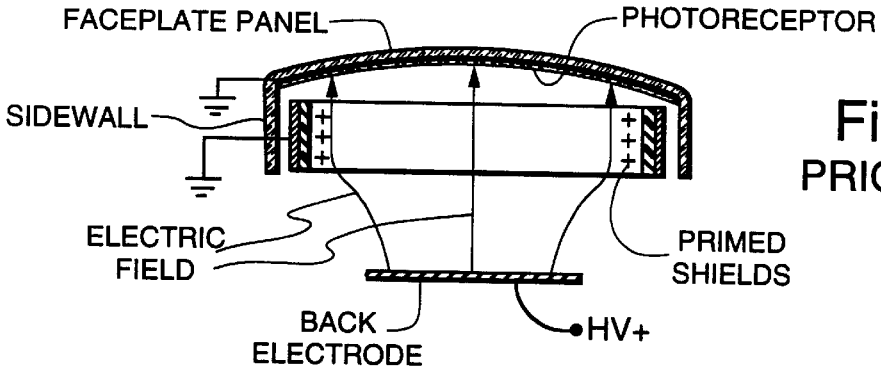
Fig. 2 PRIOR ART
FIG. 2 is a schematic diagram of the electric field lines between the back lectrode and the photoreceptor, after the prior art sidewall shields are primed.
Figure 3:
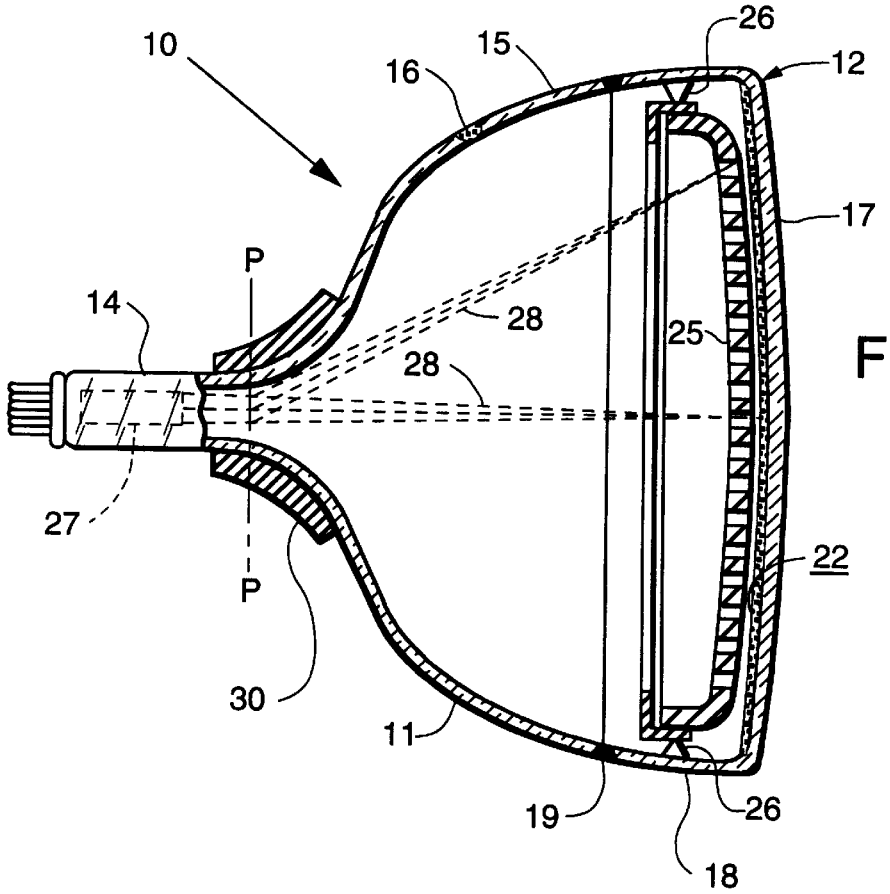
FIG. 3 is a plane view, partially in axial section, of a color CRT made according to the present method.
Figure 4:
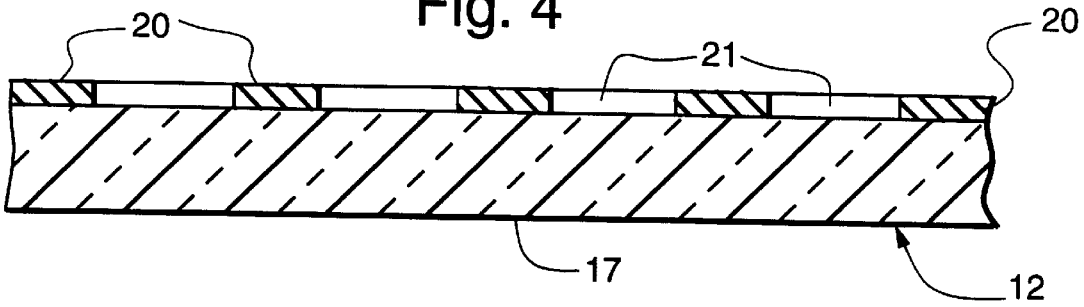
FIG. 4 is a section of a CRT faceplate panel with a matrix on an interior surface thereof during one step of the manufacturing process.
Figure 5:
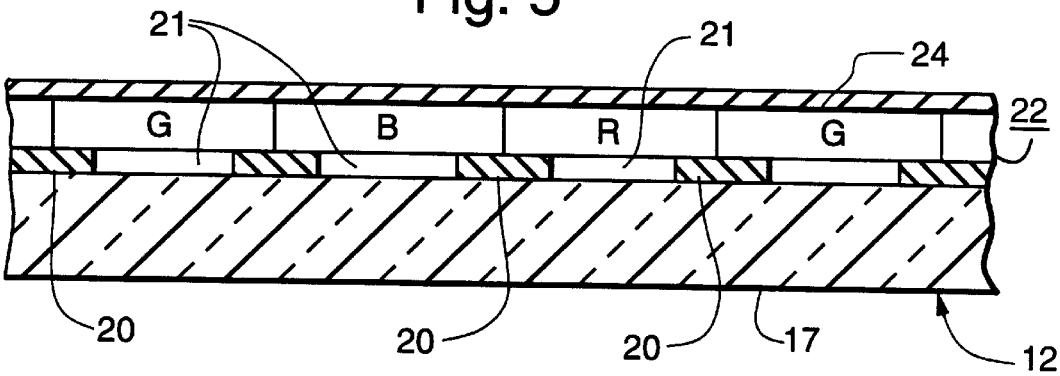
FIG. 5 is a section of a completed screen assembly of the tube shown in FIG. 3.

FIG. 3 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. Preferably, the internal conductive coating consists essentially of iron oxide and graphite, as is known in the art. The panel 12 comprises a viewing faceplate 17 and a peripheral flange or sidewall 18, which is sealed to the funnel 15 by a glass frit 19. As shown in FIG. 4, a relatively thin, light absorbing matrix 20, having a plurality of openings 21, is provided on an interior surface of the viewing faceplate 17. A luminescent three-color phosphor screen 22 is carried on the interior surface of the faceplate 17 and overlies the matrix 20. The screen 22, shown in FIG. 5, preferably, is a line screen which includes a multiplicity of screen elements comprised of red-, blue-, and green-emitting phosphor strips, R, B, and G, centered in different ones of the matrix openings 21 and arranged in color groups or picture elements of three strips or triads, in a cyclic order. The strips extend in a direction, which is generally normal to the plane in which the electron beams are generated. In the normal viewing position of the embodiment, the phosphor strips extend in the vertical direction. Preferably, portions of the phosphor strips overlap at least a portion of the light absorpting matrix 20 surrounding the openings 21. Alternatively, a dot screen also may be utilized. A thin conductive layer 24, preferably of aluminum, overlies the screen 22 and provides means for applying a uniform potential to the screen, as well as for reflecting light, emitted from the phosphor elements, through the faceplate 17. The screen 22 and the overlying aluminum layer 24 comprise a screen assembly. Again with reference to FIG. 3, a multi-apertured color selection electrode, such as a shadow mask, a tension mask or a focus mask, 25 is removably mounted, by conventional means, in predetermined spaced relation to the screen assembly. The color selection electrode 25 is detachably attached to a plurality of studs 26 embedded in the sidewall 18 of the panel 12, in a manner known in the art.

An electron gun 27, shown schematically by the dashed lines, is centrally mounted within the neck 14, to generate and direct three electron beams 28 along convergent paths, through the apertures in the color selection electrode 25, to the screen 22. The electron gun is conventional and may be any suitable gun known in the art.

The tube 10 is designed to be used with an external magnetic deflection yoke, such as yoke 30, located in the region of the funnel-to-neck junction. When activated, the yoke 30 subjects the three beams 28 to magnetic fields, which cause the beams to scan horizontally and vertically, in a rectangular raster, over the screen 22. The initial plane of deflection (at zero deflection) is shown by the line P—P in FIG. 3, at about the middle of the yoke 30. For simplicity, the actual curvatures of the deflection beam paths, in the deflection zone, are not shown.

Figure 6:
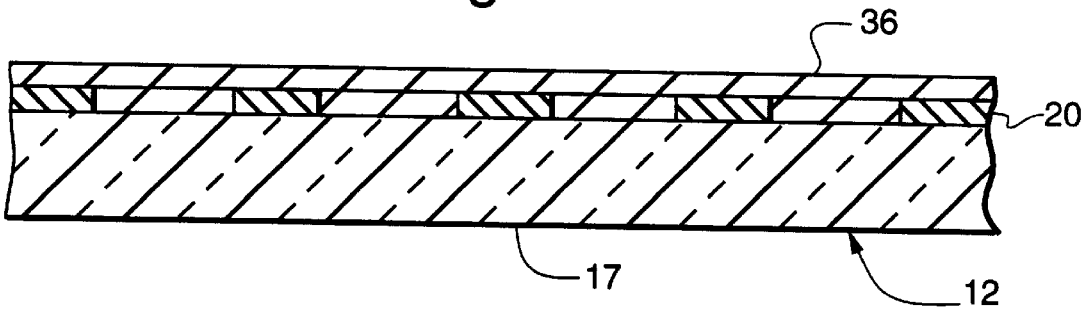
FIG. 6 is a section of the CRT faceplate panel showing a photoreceptor overlying the matrix during another step of the manufacturing process.

The screen 22 is manufactured by an electrophotographic screening (EPS) process that is described in U.S. Pat. No. 4,921,767 issued to Datta et al. on May 1, 1990. Initially, the panel 12 is cleaned by washing it with a caustic solution, rinsing it in water, etching it with buffered hydrofluoric acid and rinsing it again with water, as is known in the art. The interior surface of the viewing faceplate 17 is then provided with the light absorbing matrix 20, preferably, using the conventional wet matrix process described in U.S. Pat. No. 3,558,310 issued to Mayaud on Jan. 26, 1971. In the wet matrix process, a suitable photoresist solution is applied to the interior surface, e.g., by spin coating, and the solution is dried to form a photoresist layer. Then, the color selection electrode 25 is inserted into the panel 12 and the panel is placed onto a three-in-one lighthouse (not shown) which exposes the photoresist layer to actinic radiation from a light source which projects light through the openings in the color selection electrode. The exposure is repeated two more times with the light source located to simulate the paths of the electron beams from the three electron guns. The light selectively alters the solubility of the exposed areas of the photoresist layer. After the third exposure, the panel is removed from the lighthouse and the color selection electrode is removed from the panel. The photoresist layer is developed, using water, to remove the more soluble areas thereof, thereby exposing the underlying interior surface of the viewing faceplate, and leaving the less soluble, exposed areas of the photoresist layer intact. Then, a suitable solution of light-absorbing material is uniformly provided onto the interior surface of the faceplate panel to cover the exposed portion of the viewing faceplate and the retained, less soluble, areas of the photoresist layer. The layer of light-absorbing material is dried and developed using a suitable solution which will dissolve and remove the retained portion of the photoresist layer and the overlying light-absorbing material, forming openings 21 in the matrix 20 which is adhered to the interior surface of the viewing faceplate. For a panel 12 having a diagonal dimension of 51 cm (20 inches), the openings 21 formed in the matrix 20 have a width of about 0.13 to 0.18 mm, and the opaque matrix lines have a width of about 0.1 to 0.15 mm. The interior surface of the viewing faceplate 17, having the matrix 20 thereon, is then coated with a suitable layer of a volatilizable, organic conductive (OC) material, not shown, which provides an electrode for an overlying volatilizable, organic photoconductive (OPC) layer, also not shown. The OC layer and the OPC layer, in combination, comprise a photoreceptor 36, shown in FIG. 6.

Suitable materials for the OC layer include certain quaternary ammonium polyelectrolytes described in U.S. Pat. No. 5,370,952 issued to P. Datta et al. on Dec. 6, 1994. Preferably, the OPC layer is formed by coating the OC layer with a solution containing polystyrene; an electron donor material, such as 1,4-di(2,4-methyl phenyl)-1,4 diphenylbutatriene (2,4-DMPBT); electron acceptor materials, such as 2,4,7-trinitro-9-fluorenone (TNF) and 2-ethylanthroquinone (2-EAQ); and a suitable solvent, such as toluene, xylene, or a mixture of toluene and xylene. A surfactant, such as silicone U-7602 and a plasticizer, such as dioctyl phthalate (DOP), also may be added to the solution. The surfactant U-7602 is available from Union Carbide, Danbury, CT. The photoreceptor 36 is uniformly electrostatically charged using a corona discharge device (not shown), but described in U.S. Pat. No. 5,519,217, issued on May 21, 1996, to Wilbur et al., which charges the photoreceptor 36 to a voltage within the range of approximately +200 to +700 volts. The color selection electrode is then inserted into the panel 12, which is placed onto a lighthouse (also not shown) and the positively charged OPC layer of the photoreceptor 36 is exposed, through the color selection electrode 25, to light from a xenon flash lamp, or other light source of sufficient intensity, such as a mercury arc, disposed within the lighthouse. The light which passes through the apertures in the color selection electrode 25, at an angle identical to that of one of the electron beams from the electron gun of the tube, discharges the illuminated areas on the photoreceptor 36 and forms a latent charge image (not shown). The color selection electrode 25 is removed from the panel 12 and the panel is placed onto a first phosphor developer 40, such as that shown in FIG. 7.

The phosphor developer 40 comprises a developer tank 42 having a sidewall 44 closed at one end by a bottom portion 46 and at the top end by a panel support 48, preferably made of PLEXIGLAS™ or another insulative material, having an opening 50 therethrough to provide access to the interior of the faceplate panel 12. The sidewall 44 and bottom portion 46 of the developer tank 42 are made of an insulator, such as PLEXIGLAS™, externally surrounded by a ground shield made of metal. A back electrode 52 is disposed within the developer tank 42 and is spaced about 25 to 30 cm beneath the center of the interior surface of the faceplate panel 12 and is substantially parallel thereto. A positive potential of about 25 to 35 kV is applied to the back electrode 52 and the organic conductor of the photoreceptor 36 is grounded. With a spacing of 30 cm between the back electrode 52 and the faceplate panel 12, a drift field of 1 kV/cm or $10^5$ V/m is established.

Phosphor material, in the form of dry powder particles, of the desired light-emitting color is dispersed from a phosphor feeder 54, for example by means of an auger, not shown, into an air stream which passes through a tube 56 into a venturi 58 where it is mixed with the phosphor particles. The air-phosphor mixture is channeled into a tube 60, which imparts a triboelectric charge to the phosphor powder due to contact between the phosphor particles and the interior surface of the tube 60. For example, to positively charge the phosphor material a polyethylene tube is used. The highly charged phosphor-air mixture passes through a sealed manifold 62 of PVC tubing which terminates in a pair of commercially available nozzle heads 64. The manifold 62 rotates above the back electrode 52 while the phosphor-air mixture is sprayed into the developer tank 42 above the back electrode. The electrostatic force, arising from the combination of the back electrode 52 being held at a high positive potential and the photoreceptor 36, which is disposed on the interior viewing surface of the rectangular panel 12, being held at ground potential, drives the phosphor onto the photoreceptor. To prevent the deposition of phosphor material on the inner sidewall of the rectangular panel 12, a bias shield 65, comprising two pairs of panel skirt sidewall shields 66 and 68, is utilized. Each of the shields 66 and 68 has two oppositely disposed major surfaces. The shields 66 are spaced from the short sides of the panel sidewall while the shields 68 are spaced from the long sides of the panel sidewall. The shields 66 and 68 are formed of an insulative material, such as UHMW polyethylene, and have a thickness of about 9.5 mm and a height of about 10 cm for a faceplate panel having a diagonal dimension of about 51 cm. The pairs of shields 66 and 68 have a dielectric constant that is twice that of vacuum. A ground plate 70, shown in FIG. 8, is disposed on one of the major surfaces of the shields 66 and 68.

To prevent the accumulation of phosphor particles on the shields 66 and 68 and to influence the deposition of the phosphor materials, the shields, shown in FIG. 8, are provided with a conductive strip 72 to which a suitable bias potential, V, is applied. The resultant electric field is now established by the combination of the bias potential, V, and by the field induced by the potential applied to the back electrode 52. If the height of the conductive strip 72 is approximately 5 mm, and a potential of 25 kV is applied to the back electrode 52, located 25 cm from the photoreceptor 36 on the interior surface of the faceplate panel 12, then the voltage drop across a 5 mm gap, corresponding to the height of the strip 72, would be about 500 volts. With the OPC of the photoreceptor 36 charged to about +300 volts, and with a bias voltage in the range of 0 to +4.5 kV applied to the strip 72 the bias voltage could be utilized to influence the deposition of the phosphor materials at the periphery of the photoreceptor to tailor the amount of phosphor deposited at the edge of the screen by providing an electric field different from that which would occur without the conductive strip 72. The effect of a biased conductive strip is summarized in the TABLE below. This TABLE contains the data of a series of experiments that were conducted with a shield 66 only constructed for the 9 o'clock edge of the screen and completely overlaid on its interior (opposite to the panel skirt) side with a conductive electrode to which a bias voltage, V, was applied. The height of the conductive strip 72 was approximately 5 cm and the closest edge of the conductive strip was approximately 0.5 cm from the photoreceptor 36, with the closest edge of the conductive strip substantially parallel to the local contour of the panel surface supporting the photoreceptor 36. As the bias voltage, V, was adjusted in the range of zero to 4.5 kV, and the developer was operated with about 25 kV applied to the back electrode 52, substantial bias voltage-dependent changes were observed in the phosphor deposit on the shield 66 as well as in the peripheral regions of the phosphor screen. Specifically, with zero voltage applied to the shield 66, i.e., with the shield grounded, the entire shield was covered with a heavy deposit and the peripheral screen regions were covered with a thin layer of phosphor. With a bias voltage in the range of 0.5 to 2.5 kV, the phosphor layer on the peripheral regions of the active screen reached the same approximate thickness as that in the center of the screen, and a progressively increasing phosphor-free clear zone was observed on the shield in the vicinity of the shield edge closest to the photoreceptor 36. As the bias voltage, V, was further increased, the above-described clear zone increased further (see TABLE) and the phosphor coverage of the peripheral regions of the active screen became progressively thinner.

TABLE

| Bias Voltage (kV) | Clear Zone (in) | Clear Zone (cm) |
|---|---|---|
| 0.5 | 0.25 | 0.635 |
| 1.5 | 0.69 | 1.753 |
| 2.5 | 0.75 | 1.905 |
| 3.5 | 1.1 | 2.794 |
| 4.5 | 1.25 | 3.175 |

Figure 9:
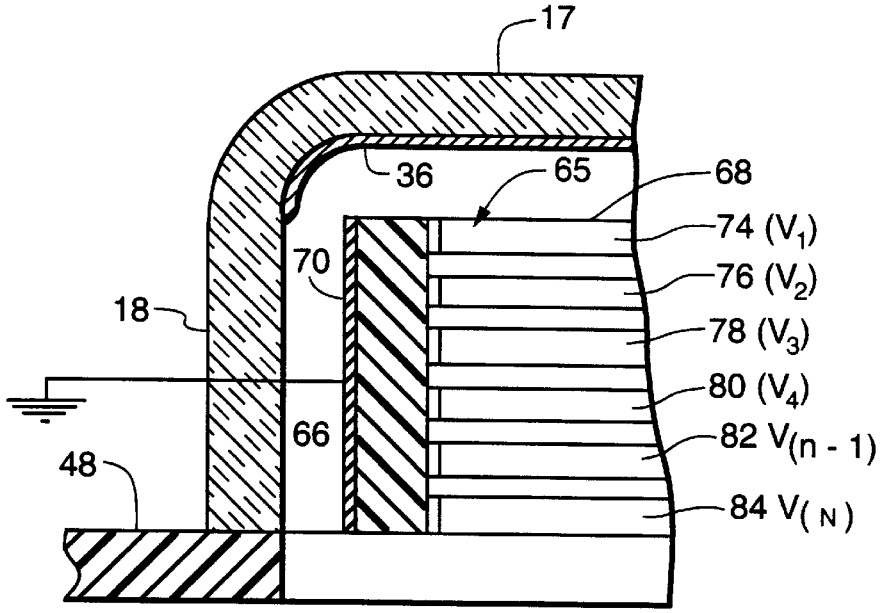
FIG. 9 shows a second embodiment of the bias shield.

In a second embodiment of the invention, shown in FIG. 9, the pairs of shields 66 and 68 have the ground plate 70 disposed on the major surface facing the faceplate sidewall 18. On the oppositely disposed major surface a plurality of conductive strips 74, 76, 78, 80, 82 and 84 are provided. Each of the conductive strips has a different voltage applied thereto. While six conductive strips are shown, it is within the scope of the invention to use either a greater or a lesser number of strips. In this embodiment, $V_1$ =3775 volts, $V_N$ =8925 volts and the intermediate voltages are proportionally established to approximate the local electric potential that is created by the parallel plate combination of back electrode 52 and the photoreceptor 36.

Figure 10:
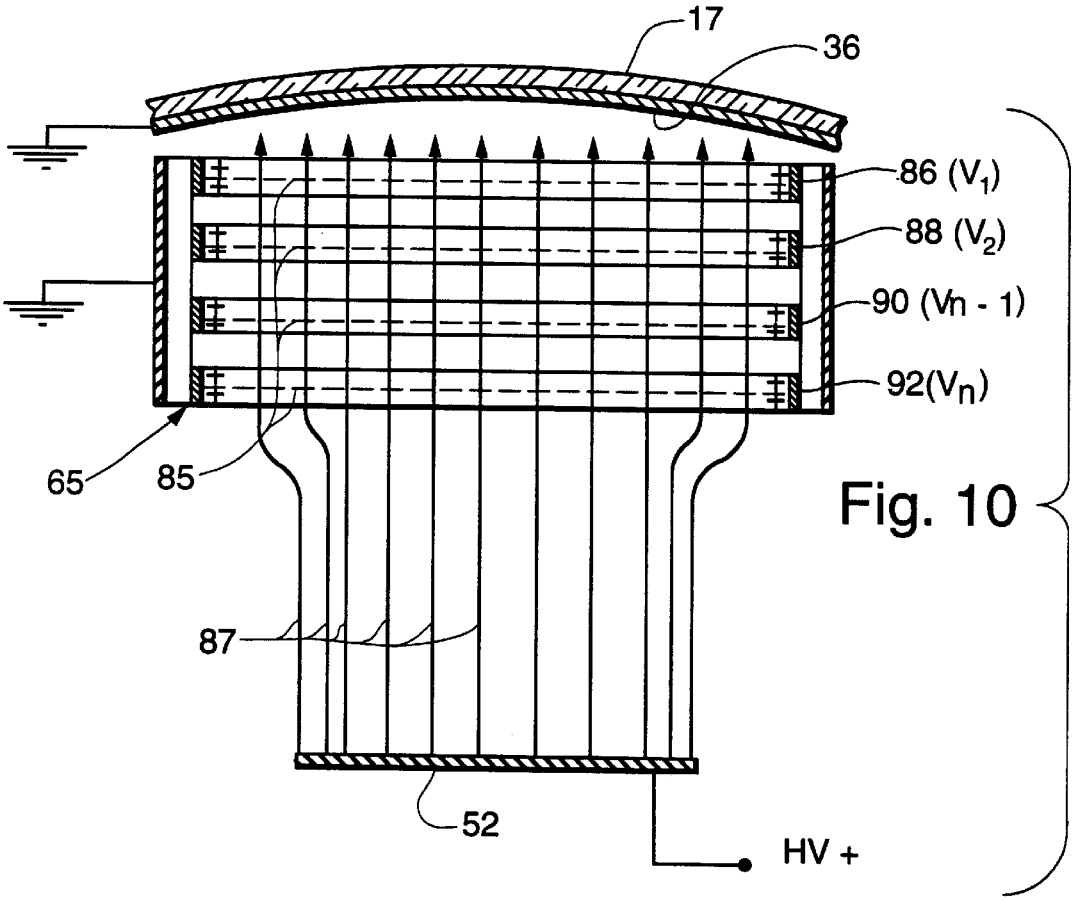
FIG. 10 is a schematic diagram of the electric field lines between the back electrode and the photoreceptor for the second embodiment shown in FIG. 9.

FIG. 10 shows the dashed equipotential lines 85 for a plurality of conductive strips with voltages $V_1$, $V_2$, $V_{N-1}$ and $V_N$ applied thereto. The equipotential lines 85 are substantially parallel to the conductive strips. A high voltage, HV, within the range of 25 to 35 kV is applied to the back electrode 52. The resultant electric field lines 87 are substantially normal to the direction of the equipotential lines 85. These electric field lines uniformly direct the phosphor materials, in straight lines, toward the photoreceptor 36.

Figure 11:
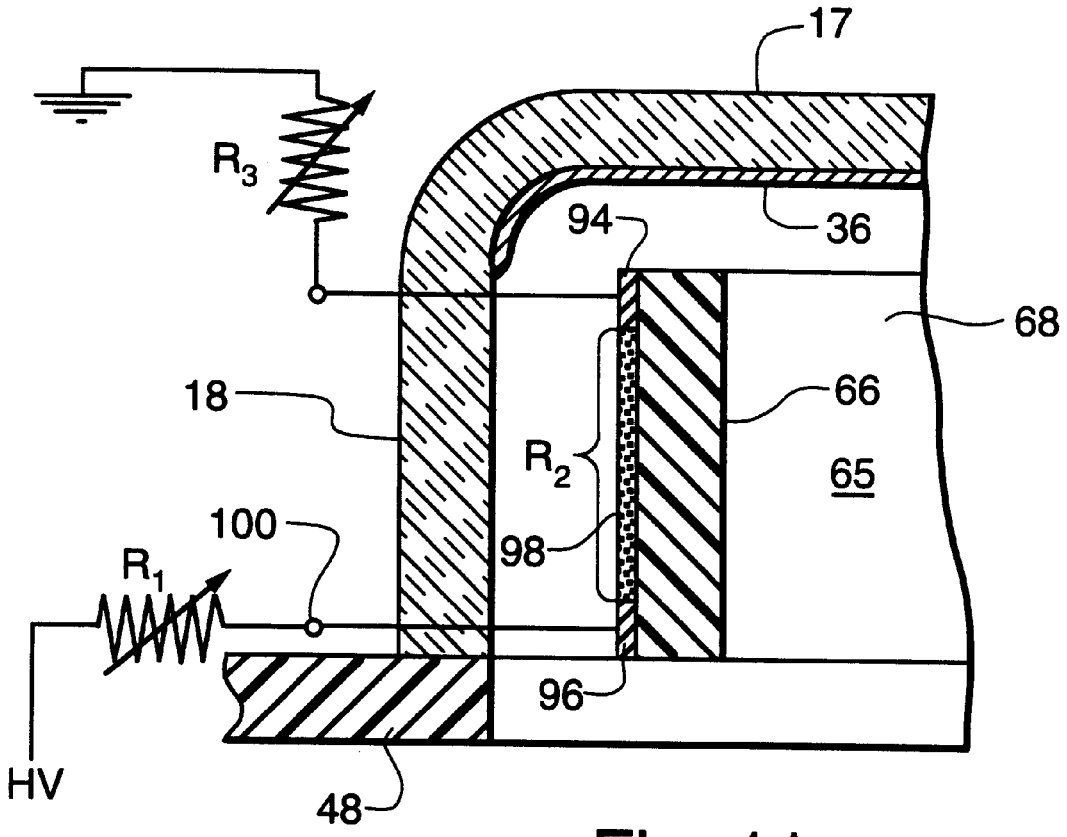
FIG. 11 shows a third embodiment of the bias shield.

FIG. 11 shows another embodiment of the invention. In this embodiment, two conductive strips 94 and 96 are disposed on the major surface of the insulative members 66 and 68 facing the faceplate sidewall 18. A high resistance coating 98, made from a mixture of carbon black and a suitable binder, is deposited on the sidewall-facing surfaces of the insulative members 66 and 68, between and in contact with the conductive strips 94 and 96. As shown in FIG. 11, the resistive coating 98 forms a resistor $R_2$, in a voltage divider that further includes variable resistors $R_1$ and $R_3$. One side of variable resistor $R_1$ is connected to the high voltage power supply, HV that provides the voltage to back plate 52, shown in FIG. 7. The other side of variable resistor $R_1$ is connected to the conductive strip 96. Variable resistor $R_3$ is connected between ground and conductive strip 94. Variable resistors $R_1$ and $R_3$ are adjusted to provide a low potential on strip 94 and a high potential on strip 96. The potential on strip 94 is set close to, but somewhat higher than, the potential on photoreceptor 36, such that it closely matches the local potential that would be created by a parallel plate combination of the photoreceptor 36 and the back electrode 52. Likewise, the potential on coating 98 is set to be approximately equal to that corresponding to the local potential what would be created by a parallel plate combination of the photoreceptor 36 and the back electrode 52. The resultant potential across $R_2$ and the shields 66 and 68 is adjustable to provide the desired continuous potential gradient on the shields to prevent the deposition of phosphor materials thereon and to influence the deposition of phosphor materials at the edge of the photoreceptor 36. The actual values of $R_1$ and $R_3$ are empirically selected. Other materials that may be used to form the high resistance coating 98 include resistive inks, chrome oxide, and cermet. Cermet is a sputter-deposited material that is described in U.S. Pat. No. 4,010,312 issued to Pinch et al. An alternate high voltage supply, not shown, can be connected at point 100 of the voltage divider, to permit dynamic control of the electric field.

What is claimed is:

1. A method for developing a latent charge image on a photoreceptor which is disposed on an interior surface of a faceplate panel of a cathode-ray tube (CRT) with triboelectrically-charged, dry-powdered, light-emitting phosphor materials, said faceplate panel having a peripheral sidewall, said method comprising the steps of positioning said faceplate panel on a panel support of a developer, said developer including a bias shield comprising two pairs of insulative members, each of said insulative members having two oppositely disposed major surfaces with at least one conductive strip formed on one of said surfaces, said insulative members being located around said peripheral sidewall of said faceplate panel, a tank having a tank sidewall closed at one end by a bottom portion and at the other end by said panel support having an opening therethrough to provide access to said faceplate panel, a back electrode disposed within said tank and spaced from, but substantially parallel to, said interior surface of the faceplate panel;

grounding said photoreceptor;

providing a voltage to said conductive strip on said insulative members to prevent said triboelectrically-charged phosphor materials from accumulating thereon and to influence the deposition of said phosphor material;

providing a positive potential to said back electrode to establish a drift field between said back electrode and said photoreceptor; and introducing said triboelectrically-charged, dry-powdered, light emitting phosphor material into said tank, between said back electrode and said faceplate panel, said triboelecrically-charged phosphor materials having a charge of the same polarity as the potential applied to said back electrode, whereby said phosphor material is directed toward said photoreceptor on said faceplate panel.

* * * * *